United States Patent [19]

Tanaka et al.

[11] Patent Number: 4,528,045

[45] Date of Patent: Jul. 9, 1985

[54] HEAT-RESISTING SPHEROIDAL GRAPHITE CAST IRON

[75] Inventors: Yoshimasa Tanaka, Ayase; Minoru Uchino, Yokohama; Hideki Yagi, Kumagaya; Iwao Teshima, Kumagaya; Kensei Matsuki, Kumagaya, all of Japan

[73] Assignees: Nissan Motor Co., Ltd., Yokohama; Kabushikikaisha Riken, Tokyo, both of Japan

[21] Appl. No.: 549,403

[22] Filed: Nov. 7, 1983

[30] Foreign Application Priority Data

Nov. 10, 1982 [JP] Japan ..... 57-196092

[51] Int. Cl.[3] ..... C22C 37/04

[52] U.S. Cl. ..... 148/35; 75/128 C; 75/128 D; 75/128 E

[58] Field of Search ..... 148/35, 139; 75/128 D, 75/128 C, 128 E, 130 A, 130 AB, 130.5

[56] References Cited

U.S. PATENT DOCUMENTS 3,740,212 6/1973 Church ..... 75/128 D

FOREIGN PATENT DOCUMENTS 0953445 12/1949 France ..... 75/128 D
1056979 3/1954 France ..... 148/35
38-22114 10/1963 Japan ..... 75/128 D
58-71353 4/1983 Japan ..... 75/128 D

*Primary Examiner*—L. Dewayne Rutledge
*Assistant Examiner*—Debbie Yee
*Attorney, Agent, or Firm*—Schwartz, Jeffery, Schwaab, Mack, Blumenthal & Evans

[57] ABSTRACT

A heat-resisting spheroidal graphite cast iron comprises carbon ranging from 1.8 to 3.4% by weight, silicon ranging from 3.5 to 6% by weight, manganese ranging from 0.7 to 1.25% by weight, chromium ranging from 3 to 5% by weight, nickel ranging from 18 to 24% by weight, an element for spheroidizing graphite, not more than 0.1% by weight, and the balance being substantially iron, thereby attaining excellent oxidation-resistance and oxide film adherance characteristics while being kept inexpensive.

7 Claims, 3 Drawing Figures

HEAT-RESISTING SPHEROIDAL GRAPHITE CAST IRON

BACKGROUND OF THE INVENTION

1. Field of the Invention

This invention relates to a spheroidal graphite cast iron high in oxidation-resistance.

2. Description of the Prior Art

As conventional heat-resisting spheroidal graphite cast irons which require oxidation-resistance, there are high nickel content austenitic spheroidal graphite cast irons (niresist ductile iron) one example of which contains carbon (C), silicon (Si), manganese (Mn), chromium (Cr), nickel (Ni) and magnesium (Mg) in amounts of 1.78, 5.05, 0.55, 1.80, 35.8 and 0.079% by weight, respectively; the other example in amounts of 2.54 (C), 2.91 (Si), 1.05 (Mn), 3.03 (Cr), 20.0 (Ni), 0.016 (P), 0.011 (S) and 0.076 (Mg), respectively.

However, the former cast iron is expensive because of the high nickel content whereas the latter cast iron is inferior in oxidation-resistance and close adherance characteristics of oxide film (scale). Accordingly, conventional spheroidal graphite cast irons have been impossible to meet both the requirements of lower cost and excellent property.

SUMMARY OF THE INVENTION

A heat-resisting spheroidal graphite cast iron according to the present invention comprises carbon ranging from 1.8 to 3.4% by weight, silicon ranging from 3.5 to 6% by weight, manganese ranging from 0.7 to 1.25% by weight, chromium ranging from 3 to 5% by weight, nickel ranging from 18 to 24% by weight, an element for spheroidizing graphite, not more than 0.1% by weight, and the balance being substantially iron. By virtue of the above-mentioned content of each element, the spheroidal graphite cast iron of the present invention is excellent in heat-resistance at high temperatures and in close adherance characteristics of oxide film (scale) while being kept inexpensive.

BRIEF DESCRIPTION OF THE DRAWINGS

The features and advantages of the heat-resisting spheroidal graphite cast iron according to the present invention will be more clearly appreciated from the following description taken in conjunction with the accompanying drawings, in which.

DETAILED DESCRIPTION OF THE INVENTION

Figure 1:
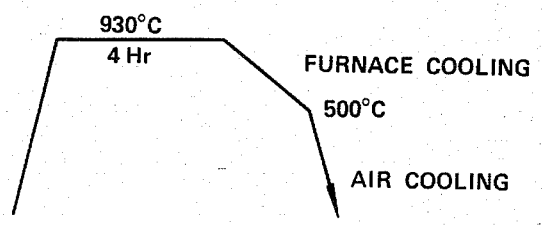
FIG. 1 is a graphical representation illustrating the annealing made against test pieces or specimens of the spheroidal graphite cast irons.

According to the present invention, a heat-resisting austenite spheroidal graphite cast iron comprises carbon ranging from 1.8 to 3.4% by weight, silicon ranging from 3.5 to 6% by weight, manganese ranging from 0.7 to 1.25% by weight, chromium ranging from 3 to 5% by weight, nickel ranging from 18 to 24% by weight, an element for spheroidizing graphite, not more than 0.1% by weight, and the balance being substantially iron.

The above-mentioned range of each component of the heat-resisting spheroidal graphite cast iron according to the present invention has been limited for the reasons discussed hereinafter.

Carbon (C): 1.8 to 3.4% by weight

Carbon is essential for cast iron and useful for improving the fluidity of molten metal. If the carbon content is less than 1.8% by weight, chill tends to arise during casting and the fluidity of the molten metal is degraded, thereby causing casting defect. Additionally, if the carbon content is more than 3.4% by weight, an excessive amount of graphite is crystallized out and therefore the resultant casting is lowered in ductility and mechanical strength. Consequently, the carbon content has been limited within the range from 1.8 to 3.4% by weight.

Silicon (Si): 3.5 to 6% by weight

Silicon is usually added for cast iron for the purpose of graphitizing treatment. However, according to the present invention, silicon is contained within a higher range than as usual for the purpose of improving oxidation-resistance of the resultant casting in addition to the above-mentioned graphitizing treatment. In this connection, it is be noted that as the silicon content increases, the oxidation-resistance is improved whereas the elongation of the resultant casting is degraded thereby to become brittle. Consequently, the silicon content has been limited within the range from 3.5 to 6% by weight.

Manganese (Mn): 0.7 to 1.25% by weight

Manganese is an element functioning desulfurizing and generally contained in usual cast iron. In the cast iron according to the present invention, manganese is contained within the range not less than 0.7% by weight. However, too much manganese content promotes the production of carbide and therefore the upper limit has been decided to be 1.25% by weight.

Chromium (Cr): 3 to 5% by weight

Chromium is an element contributing to strengthening the matrix and improving oxidation-resistance at high temperatures. If the chromium content is less than 3% by weight, such contribution is not sufficient in which particularly the close adhesion characteristics of oxide film or scale is deteriorated so that the oxide film tends to peel off. Consequently, the chromium content not less than 3% by weight is necessary particularly in case where the resultant casting is used as the material of, for example, a turbine housing of a turbocharger subjected to high temperature engine exhaust gas. Additionally, if the chromium content is more than 5% by weight, the amount of carbide increases so that the resultant casting becomes brittle. Consequently, the chromium content has been limited within the range from 3 to 5% by weight.

Nickel (Ni): 18 to 24% by weight

Nickel is an element for austenitizing the matrix of the cast iron and contributing to improving ductility and high temperature deformation resistance characteristics. It is to be noted that the nickel content not less than 18% by weight is necessary to obtain a complete austenite matrix. However, the nickel content more than 24% by weight no longer improves the above-mentioned austenitizing effect of nickel while causing a noticeable cost increase. Consequently, the nickel content has been limited within the range from 18 to 24% by weight.

The element for spheriodizing graphite: not more than 0.1% by weight

As the element for graphite spheroidizing, magnesium (Mg), calcium (Ca), cerium (Ce) or the like is used. For instance, too much magnesium content stabilizes cementite, and accordingly it is necessary to set the upper limit of the magnesium content to a value of 0.1% by weight. Regarding the other elements for graphite spheroidizing, too much content is likewise not preferable. Consequently, the content of the element for graphite spheroidizing has been limited within the range not more than 0.1% by weight.

It will be understood that a slight amount of molybdenum (Mo) or the like may be added as a component of the cast iron in an amount within a range in which the austenitic structure is not changed.

It is to be noted that too much content of phosphorus (P) lowers the ductility of the resultant casting, and too much content of sulphur (S) impedes the spheroidizing of graphite. Accordingly, it is preferable to keep the content of these elements at a lower value same as in usual spheroidal graphite cast irons.

In order to evaluate the spheroidal graphite cast iron according to the present invention, Examples (Sample Nos. 1 and 2) of the present invention will be discussed hereinafter in comparison with Comparative Examples (Sample Nos. 3 and 4).

The Sample Nos. 3 and 4 correspond to conventional high nickel content austenitic spheroidal graphite cast iron (niresist ductile iron) in which Sample No. 3 is too expensive because of high nickel content while Sample No. 4 is inferior in oxidation resistance and close adhesion characteristics of oxide film (scale).

Four kinds (Sample Nos. 1 to 4) of spheroidal graphite cast irons having chemical compositions shown in Table 1 were prepared to investigate the mechanical property and oxidation-resistance thereof. The test pieces or specimens of Sample Nos. 1 to 4 were subjected to furnace cooling after being heated at 930° C. for 4 hours, and then subjected to annealing in which air cooling was made from a temperature of 500° C. as shown in FIG. 1. The tests for the mechanical property were conducted at the rate of strain of 20%/min and at a test temperature of 900° C. in accordance with Japanese Industrial Standard Z 2241, using a tension test specimen which is 50 mm in distance between gage marks, 70 mm in length of the test section, and 10 mm in diameter of the test section. The oxidation-resistance was such evaluated that the test piece was subjected to 100 cycles of oxidizing (each cycle includes 30 minutes heating and 15 minutes cooling) at temperatures of 800° C. and 900° C., and thereafter the reduction amount of the thickness of the test piece was determined.

Figure 2:
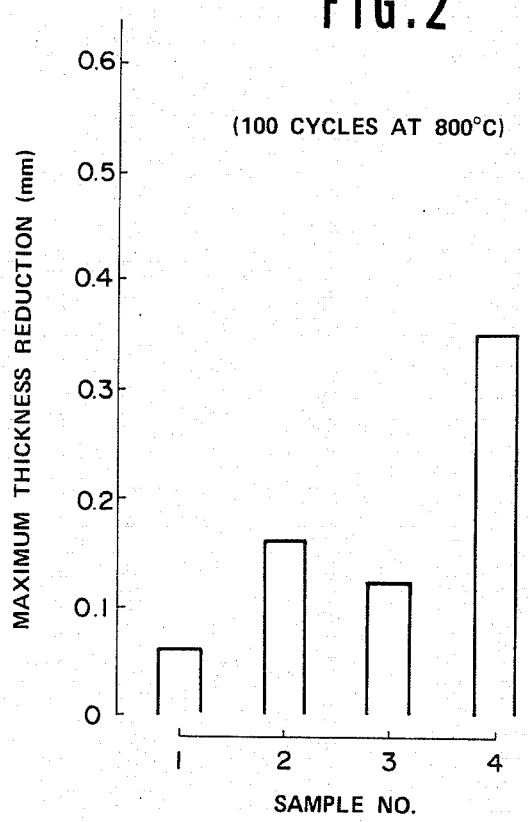
FIG. 2 is a graph showing the oxidation resistance characteristics of the spheroidal graphite cast irons according to the present at a temperature of 800° C. in comparison with conventional spheroidal graphite cast irons.
Figure 3:
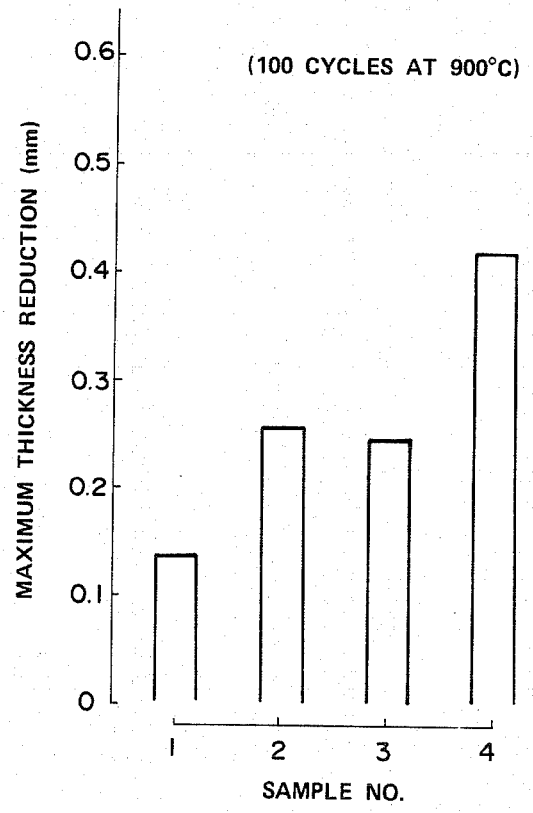
FIG. 3 is a graph similar to FIG. 2, but showing the oxidation resistance characteristics of the spheroidal graphite cast irons according to the present invention at a temperature of 900° C.

The result of the mechanical property test is shown in Table 2, while the evaluation of the oxidation-resistance is shown in FIGS. 2 and 3.

TABLE 1

| Sample | Chemical Composition (Wt %) | | | | | | | | | |
|---|---|---|---|---|---|---|---|---|---|---|
| No. | C | Si | Mn | Cr | Ni | P | S | Mg | Fe | Reference |
| 1 | 2.05 | 5.07 | 1.11 | 3.43 | 19.7 | 0.016 | 0.011 | 0.076 | balance | Present Invention |
| 2 | 2.29 | 4.83 | 1.15 | 3.00 | 20.1 | 0.015 | 0.010 | 0.074 | balance | Present Invention |
| 3 | 1.78 | 5.05 | 0.55 | 1.80 | 35.8 | 0.009 | 0.011 | 0.079 | balance | Comparative Example |
| 4 | 2.54 | 2.91 | 1.05 | 3.03 | 20.0 | 0.016 | 0.011 | 0.076 | balance | Comparative Example |

TABLE 2

| Sample No. | Mechanical Property (at 900° C.) Tensile strength ($kgf/mm^2$) | 0.2% yield strength ($Kgf/mm^2$) | Elongation (%) |
|---|---|---|---|
| 1 | 11.2 | 4.7 | 36.4 |
| 2 | 10.0 | 4.2 | 34.5 |
| 3 | 10.1 | 5.5 | 40.0 |
| 4 | 14.3 | 6.7 | 31.8 |

The graphs of FIGS. 2 and 3 reveal that Sample Nos. 1 and 2 (Examples of the present invention) are excellent in oxidation-resistance as compared with Sample No. 4 (Comparative Example). Besides, Sample No. 2 is close in oxidation-resistance to while Sample No. 1 is better in oxidation-resistance than Sample No. 3 (Comparative Example) which is expensive. Furthermore, the data of Table 2 shows that the mechanical properties of Sample Nos. 1 and 2 is also excellent. Moreover, it was confirmed that the close adherance of the oxide film (scale) of Sample Nos. 1 and 2 was excellent.

As will be appreciated from the above, the spheroidal graphite cast iron according to the present invention is excellent in heat- and oxidation-resistance and in oxide film adherance characteristics and low in cost. Additionally, the nodular graphite cast iron according to the present invention is particularly suitable for the material of the turbine housing of the turbocharger subjected to high temperature exhaust gas and used under severe operating conditions.

What is claimed is:

1. A heat-resisting spheroidal graphite cast iron consisting essentially of (a) carbon ranging from 1.8 to 3.4% by weight, (b) silicon ranging from 3.5 to 6% by weight, (c) manganese ranging from 0.7 to 1.25% by weight, (d) chromium ranging from 3 to 5% by weight, (e) nickel ranging from 18 to 24% by weight, and (f) not more than 0.1% by weight of at least one element for spheroidizing graphite, said element for spheroidizing graphite being selected from the group consisting of magnesium, calcium, and cerium, the balance being substantially iron, said cast iron having an austenite matrix.

2. A heat-resisting spheroidal graphite cast iron as claimed in claim 1, further comprising molybdenum in an amount such that said austenite matrix of said cast iron is retained.

3. A material of a turbine housing subjected to exhaust gas, consisting essentially of (a) carbon ranging from 1.8 to 3.4% by weight, (b) silicon ranging from 3.5 to 6% by weight, (c) manganese ranging from 0.7 to 1.25% by weight, (d) chromium ranging from 3 to 5% by weight, (e) nickel ranging from 18 to 24% by weight, and (f) not more than 0.1% by weight of at least one element for spheroidizing graphite, said element for spheroidizing graphite being selected from the group consisting of magnesium, calcium, and cerium, the balance being substantailly iron, said cast iron having an austenite matrix.

4. A turbine housing of a turbocharger, made of a material consisting essentially of (a) carbon ranging from 1.8 to 3.4% by weight, (b) silicon ranging from 3.5 to 6% by weight (c) manganese ranging from 0.7 to 1.25% by weight, (d) chromium ranging from 3 to 5% by weight, (e) nickel ranging from 18 to 24% by weight, and (f) not more than 0.1% by weight of at least one element for spheroidizing graphite, said element for spheroidizing graphite being selected from the group consisting of magnesium, calcium, and cerium, the balance being substantially iron, said cast iron having an austenite matrix.

5. A heat-resisting spheroidal graphite cast iron as claimed in claim 1, wherein said carbon ranges from 1.8 to 2.54% by weight.

6. A material of a turbine housing subjected to exhaust gas as claimed in claim 3, wherein said carbon ranges from 1.8 to 2.54% by weight.

7. A turbine housing of a turbocharger as claimed in claim 4, wherein said carbon ranges from 1.8 to 2.54% by weight.

* * * * *